United States Patent [19]

Maina

[11] Patent Number: 4,632,155

[45] Date of Patent: Dec. 30, 1986

[54] ELECTROMAGNET FOR STOPPING THE UNWINDING OF THE WEFT YARN IN WEFT FEEDING DEVICES FOR WEAVING LOOMS

[75] Inventor: Bruno Maina, Valdengo, Italy

[73] Assignee: ROJ Electrotex, S.p.A., Biella, Italy

[21] Appl. No.: 658,803

[22] Filed: Oct. 9, 1984

[30] Foreign Application Priority Data

Oct. 7, 1983 [IT] Italy ..... 23187/83[U]

[51] Int. Cl.[4] ..... D03D 47/36

[52] U.S. Cl. ..... 139/452; 335/257; 242/47.01

[58] Field of Search ..... 139/452; 242/47.01, 242/47.12, 47.13; 310/93; 335/255, 257, 274

[56] References Cited

U.S. PATENT DOCUMENTS

| | | | |
|---|---|---|---|
| 985,676 | 2/1911 | Howe | 335/257 |
| 2,735,047 | 2/1956 | Garner et al. | 335/257 |
| 3,303,445 | 2/1967 | Flentge | 335/255 |
| 3,426,304 | 2/1969 | Cannon et al. | 335/255 |
| 3,895,331 | 7/1975 | Saarem | 335/171 |
| 4,127,835 | 11/1978 | Knutson | 335/255 |
| 4,262,271 | 4/1981 | Bowers | 335/274 |
| 4,358,691 | 11/1982 | Naylor | 335/234 |
| 4,407,336 | 10/1983 | Steiner | 139/452 |
| 4,490,057 | 12/1984 | Reece | 335/257 |

FOREIGN PATENT DOCUMENTS

| | | | |
|---|---|---|---|
| 0102040 | 3/1984 | European Pat. Off. | 139/452 |

*Primary Examiner*—Henry S. Jaudon
*Assistant Examiner*—Joseph S. Machuga
*Attorney, Agent, or Firm*—Young & Thompson

[57] ABSTRACT

In an improved electromagnet structure for stopping the unwinding of the weft yarn in weft feeding devices for weaving looms, comprises—mounted in a casing—an electromagnetic coil and an armature mobile therein. The armature comprises a shank, at least partly constituted by a piece of stainless steel cable and a head of ferrous material fixed to the shank by rolling and/or plastic deformation. The head is urged, on activation of the coil, to strike against a stopping plate interposed between the casing and its closure cover, against the action of a return spring and by way of a damping washer carried by the plate.

2 Claims, 2 Drawing Figures

ELECTROMAGNET FOR STOPPING THE UNWINDING OF THE WEFT YARN IN WEFT FEEDING DEVICES FOR WEAVING LOOMS

BACKGROUND OF THE INVENTION

Italian patent No. (application No. 20307 A/83) of the present applicant describes and claims a weft feeding device for weaving looms in which the system for stopping the weft yarn unwinding from the winding unit comprises one or more electromagnets which are disposed on a funnel-shaped cap, and which when energised cause their mobile armature to engage the conical zone of the winding drum and to interpose itself between this latter and the funnel, thus preventing the unwinding of further turns. According to said patent, the armature of these electromagnets, or their stopping pin, which is constructed of a wear-resistant material, collides with the conical zone of the winding drum, which is constructed of impact-resistant material and is able to deaden the impacts, thus preventing bouncing of the armature.

The electromagnets used for implementing and said stopping system in weft feeding device must be able to undergo hundreds of operations per minute and must comprise only small mobile masses in order to ensure a large acceleration and/or very small descent time for the armature. This requires a specially designed structure, which the present invention proposes by providing it with interesting constructional arrangements. Moreover, the present invention proposes to improve the weft yarn stopping system in weft feeding devices by ensuring operation under all working conditions and with any type of weft.

With regard to the first aspect, it should be noted that the most stressed part of the electromagnet is its mobile armature, which is subjected to high impact and inertial forces and comprises easily fractured critical zones in the armature shank (the mobile armature is not always perfectly orthogonal to the axis of movement of the shank, so that a bending stress can develop in the shank 5 which favours its fracture) and at the shank retention head of said armature due to the effect of its impact against the travel arresting means, even though damping elements are present. A structure with special constructional arrangements must therefore be conceived to overcome these problems.

With regard to the second aspect, it has been noted that in some cases, when particular yarns are present, the weft yarn tends sometimes to pass between said stopping pin and its resting zone on the drum cone due to imperfect contact between the surface of this latter and the end of the pin, or due to wear of said surface as a result of continual rubbing of the yarn. It is therefore desirable to modify the yarn stopping system in order to improve its stopping reliability.

SUMMARY OF THE INVENTION

The invention completely solves the stated problems by means of an improved electromagnet for fitting to said weft feeding devices, which is characterised in that said armature comprises a shank at least partly constituted by a piece of stainless steel cable and a head of ferrous material fixed to the shank by rolling and/or plastic deformation, said head being urged on activation of the coil to strike against a stopping plate interposed between said casing and its closing cover, against the action of a return spring and by way of a damping washer.

Instead of engaging the surface of the winding drum of a weft feeding device by contact, the shank of the armature of this electromagnet is able to be inserted for a certain distance into a corresponding hole provided in the conical zone of the winding drum of said weft feeding device.

BRIEF DESCRIPTION OF THE DRAWINGS

The invention is described in detail hereinafter by way of example with reference to the accompanying drawings, in which.

DESCRIPTION OF THE PREFERRED EMBODIMENTS

Figure 1:
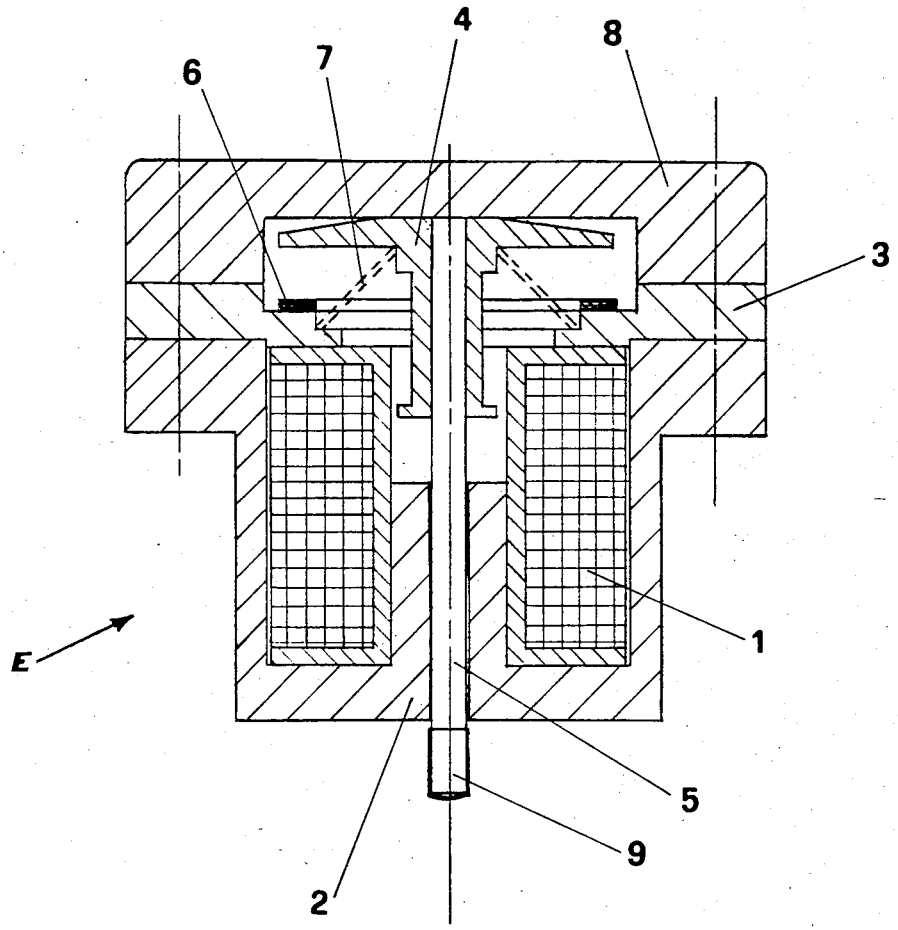
FIG. 1 is a section through the electromagnet according to the invention.

With reference to the drawings it can be seen that the electromagnet E according to the invention comprises a coil 1 traversed by electric current arranged to generate a magnetic field which, starting from a central core 2 and passing through a travel arresting plate 3, closes its circuit at the head 4 of a mobile armature. Said head 4 is thus attracted towards the central core 2, dragging with it the armature shank 5 which is fixed to it.

The mobile armature is arrested by virtue of the engagement of the head 4 against the plate 3 by way of a rubber damping element 6 fixed to said plate 3.

When the current supply to the coil 1 is interrupted, the electromagnet returns to its rest position by means of a spring 7 which raises the mobile armature.

A cover 8, besides closing the unit, also serves as a travel stop for the return of the mobile armature.

The cover 8 is preferably of plastics construction, whereas the central core 2, the travel arresting plate 3 and the head 4 of the mobile armature are of ferrous material.

For magnetic circuit reasons, the shank 5 is constructed of a magnetic material.

More precisely, to prevent easy fracture of the head 4 and shank 5, the shank of a magnetic material 5 is in the form of a piece of stainless steel cable and is fixed to the head 4 by rolling its cylindrical part, or by plastic deformation.

By virtue of possessing considerable elasticity, the metal cable is insensitive to perpendicularity errors between the axis of movement of the mobile armature and the arresting plate.

To prevent opening of the strands forming the cable, a very thin ferrule 9 can be mounted over the free end of the shank 5, and be either upset, or simply forced on or cemented.

This ferrule 9 is also constructed of wear-resistant material, because part of the weft yarn to be stopped rubs against it.

Figure 2:
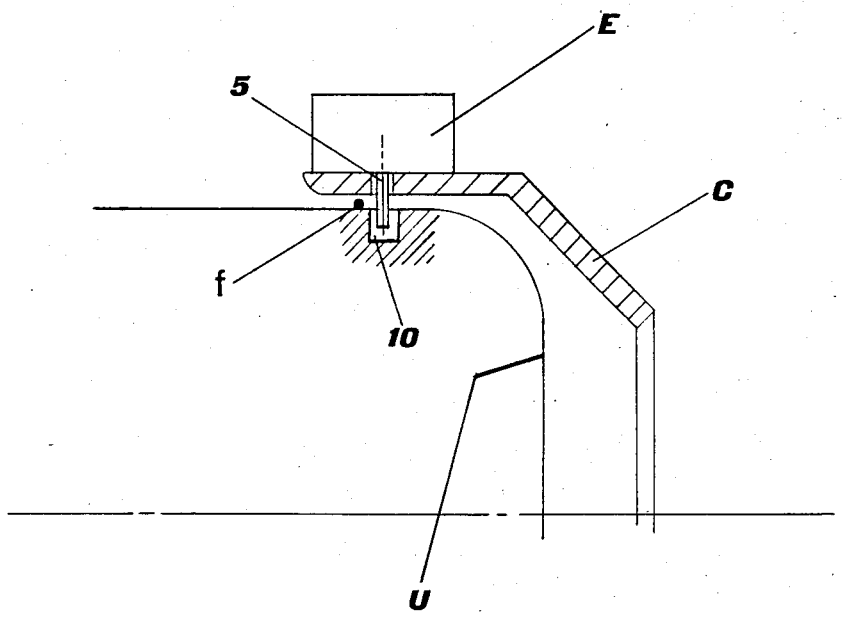
FIG. 2 is a diagrammatic representation of the manner in which the electromagnet of FIG. 1 is mounted on a weft feeding device and cooperates with its winding drum in order to stop the weft yarn.

As shown in FIG. 2, the magnet E of FIG. 1 is fixed on to the funnel-shaped cap C of the weft feeding device in such a manner that the shank 5 of its armature, which is normally retracted so as to leave the space between the funnel C and the exit cone U of the weft feeding device winding unit free, emerges when the electromagnet is energised and becomes inserted into a suitable hole 10 provided in the conical end zone of the weft feeding device winding drum.

During operation, the weft yarn f (shown in cross-section in this figure) collides against the electromagnet shank 5 to stop the unwinding of the turns; and as the yarn f is always kept slightly under tension, it is unable to become wedged inside the hole 10 and pass under the end of the shank 5, which thus stops it with complete realiability. This therefore ensures proper prevention of unwinding of the turns.

This principle is obviously valid for weft feeding devices constructed both with a single electromagnet and with several electromagnets.

It should also be noted that although in the preferred embodiment of the electromagnet according to the invention the shank 5 is constructed wholly as a metal cable which slides in the guide bore provided for it in the central core of the electromagnet, if the shank has of necessity to be constructed as a rigid element a piece of cable could be interposed between the head 4 and the shank 5 of the mobile armature, thus obtaining the same action and consequently all the advantages described heretofore.

I claim:

1. In combination with a weft feeding device winding drum, means for selectively stopping the unwinding of a weft yarn from the drum, said means comprising a shank selectively movable toward and away from the drum into and out of the path of a weft yarn unwinding from the drum, a ferrous head secured to one end of the shank, an arresting plate, a damping element fixed to said plate in a position to be contacted by said head when said shank moves toward the drum, a return spring acting on the head to urge the head away from the damping element, an electromagnetic coil surrounding the shank and adapted to urge the head in a direction toward the drum against the action of the spring, the shank being in the form of a cable of stainless steel strands.

2. Apparatus as claimed in claim 1, and a ferrule on the end of said shank opposite said head.

* * * * *